United States Patent [19]

Tönsmann et al.

[11] Patent Number: 4,739,583

[45] Date of Patent: Apr. 26, 1988

[54] DEVIATING DEVICE OF A LOCKING BAR BRACE FOR A WINDOW OR A DOOR

[75] Inventors: Armin Tönsmann, Bielefeld; Rüdiger Schmidt, Lage, both of Fed. Rep. of Germany

[73] Assignee: Schüco Heinz Schurmann GmbH & Co., Bielefeld, Fed. Rep. of Germany

[21] Appl. No.: 943,667

[22] Filed: Dec. 18, 1986

[30] Foreign Application Priority Data

Dec. 23, 1985 [DE] Fed. Rep. of Germany ..... 3545860

[51] Int. Cl.[4] ..... E05D 15/52

[52] U.S. Cl. ..... 49/192

[58] Field of Search ..... 49/192, 193

[56] References Cited

U.S. PATENT DOCUMENTS 3,994,093 11/1976 Mayer et al. ..... 49/192

4,208,838 6/1980 Kleine et al. ..... 49/192

4,637,165 1/1987 Schneider ..... 49/192

FOREIGN PATENT DOCUMENTS 7827303 1/1979 Fed. Rep. of Germany .

*Primary Examiner*—Philip C. Kannan

*Attorney, Agent, or Firm*—Erwin S. Teltscher

[57] ABSTRACT

A corner deviating device for a locking bar brace supported in a casement frame of window or a door has a one-piece housing which is provided in a corner region with a mounting opening for a spring band having drivers at its ends, the mounting opening being closable by an angular cover. One leg of the housing is insertable into a receiving groove of one wing of the casement frame, while the other leg of the housing is fixable on an edge strip of an associated receiving groove of another wing of the frame.

18 Claims, 7 Drawing Sheets

DEVIATING DEVICE OF A LOCKING BAR BRACE FOR A WINDOW OR A DOOR

BACKGROUND OF THE INVENTION

The present invention relates to a corner deviating, deflecting, or rerouting device of a locking bar brace with locking bars slidably supported in C-shaped receiving grooves of a closure or casement frame of a window or a door. The receiving grooves in all wings of the casement frame have identical cross sections, and are provided with inwardly extending edge strips which are removed in the corner region of the casement frame for forming a mounting recess. More particularly, it relates to such a corner deviating device, which has an angular housing fixed on the casement frame, and is provided with a deviating member which is formed as a spring band guided in legs of the housing, and is provided at its end with entrainment means or drivers for the associated locking bars.

Corner deviating devices of this type are known in the art. One of such corner deviating device is disclosed, for example, in the German document DE-GM 7,827,303. In this corner deviating device the housing is composed of two metal half-shells with a separating plane lying in the central plane of the housing. After the insertion of the spring band provided with drivers they are connected with one another by riveting. In this construction a driver which is directly mounted on the spring band is movable in the region of one leg of the housing, while the driver associated with the other end of the spring band lies outside of the housing and is connected with the end of the spring band by a coupling rod. The construction and mounting of the above-described device can be be further improved.

SUMMARY OF THE INVENTION

Accordingly, it is an object of the present invention to provide a corner deviating device of the above-mentioned general type, which is composed of a lower number of individual parts, wherein the arrangement of the spring band with the drivers in the housing can be carried out without any tools, and mounting of the housing on the casement frame can be performed in a simple manner.

In keeping with these objects and with others which will become apparent hereinafter, in a corner deviating device of a locking rod brace with locking rods slidably supported in C-shaped receiving grooves of a casement frame of a window or a door, with receiving grooves formed with identical cross-sections in all wings of the casement frame and which has inwardly extending edge strips which are removed in a corner region of the casement frame for forming a mounting opening, an angular housing is mountable on the casement frame and has at least two legs. A deviating member is formed as a spring band, has two ends, and is provided at the ends with drivers for the associated locking bars; the housing itself is formed as a one-piece member and has a corner region provided with a mounting opening for the spring band; and an angular cover closes the mounting opening, and the legs of the housing are formed so that one leg may be inserted into the receiving groove of one wing of the frame, while another leg may be fixed on the edge strip of the associated receiving groove of another wing of the frame. The one-piece housing with the legs, which legs extend at right angles relative to one another, and are formed as guiding passages for the spring-band forming the deviating member, is composed advantageously of a synthetic plastic material. However, it can also be formed of metal as a die-cast part.

It is particularly advantageous if the one leg of the housing has an outer bottom and is open inwardly, while the other leg of the housing is provided with an inner bottom and is open outwardly. The housing preferably has a corner region, and is provided in the corner region with cutouts. The outer bottom and the inner bottom end at a distance from the corner, and limit the cutouts at one side of the corner. An arcuate guiding piece is advantageously arranged between the cutouts for the inner side of the spring band. Preferably arresting means are provided for fixing the other leg on the edge strip.

The other leg has lower longitudinal edges, and is advantageously provided on the lower longitudinal edges with an arresting web engaging with the edge strip of the receiving groove and with a strip extending parallel to the arresting web, and supported on an outer surface of the edge strip, respectively. The cover itself has a cover leg provided with a groove, which is open at an end side thereof outwardly, and serves for receiving the edge strip of one wing of the frame, the cover leg being movable from the mounting opening of the corner region of the casement frame, in which the edge strip is removed, to the edge strip which extends to the mounting opening. The one leg of the housing has an outer bottom, the cover leg having a cover plate which extends to an end side of the outer bottom, and is provided with at least one tongue engaging the outer bottom. The angular cover has an inner side which is provided with a guiding web over the outer side of the spring band, and has an arcuate inner contour. The cover has also another leg, and the guiding web extends preferably completely over the length of one leg of the cover and partially over the length of the other legs of the cover. The one leg of the housing has additionally side walls provided with arresting openings, and the cover has wall parts which extend parallel and at a distance from the guiding web, the wall parts of the cover having outer arresting webs, and being spring biased into the arresting openings of the side walls of the one leg of the housing. The side walls of the one leg of the housing have an inner side and are provided on the inner side with arresting recesses, which extend in a longitudinal direction of the one leg of the housing, and an arresting web limits the arresting recesses. The cover advantageously has recesses, and the side walls of the one leg of the housing have an end and are provided at the end with projections which engage in the recesses of the cover in a form-locking manner. The cover has a leg which is provided with a C-shaped guiding groove for one part of the brace, the guiding groove being open outwardly and at both end sides thereof.

The drivers are advantageously mounted on the spring band, and have a movement path which lies in the region of the legs of the housing; the drivers are preferably formed as pins, and a shoe is advantageously fixed on the spring band and formed of one piece with the pins. The spring band has a predetermined width and is provided with openings, the shoe being composed of two plates having a width which is smaller than the width of the spring band; the plates are arranged at each side of the spring band and extend through the openings of the spring band with portions connected with one another. The spring band has a central longitudinal axis, and the openings of the spring band are preferably arranged in two rows which are offset at a distance relative to the central longitudinal axis, and offset relative to one another.

The insertion of the spring band with the drivers into the housing is carried out through the mounting opening provided within the corner region. The ends of the spring band are inserted one after the other from the mounting opening into the guides of the legs. Thereafter, the corner region of the housing is covered by an angular cover which is fixed on the housing by an arresting member. The fixation of the housing leg on the edge strip of the receiving groove of the associated casement frame wing is performed advantageously by an arresting web which engages behind the edge strip of the receiving groove. In this construction of the housing no tool is needed for insertion of the spring band into the housing, for fixation of the housing on the casement frame, or for mounting of the cover on the housing.

The novel features of the present invention are set forth in particular in the appended claims. The invention itself, however will be best understood from the following description of preferred embodiments, which is accompanied by the drawings.

BRIEF DESCRIPTION OF THE DRAWINGS

FIG. 7 is a view showing an angular cover for a housing, provided for covering an outer corner region;

DESCRIPTION OF THE PREFERRED EMBODIMENT

Figure 1:
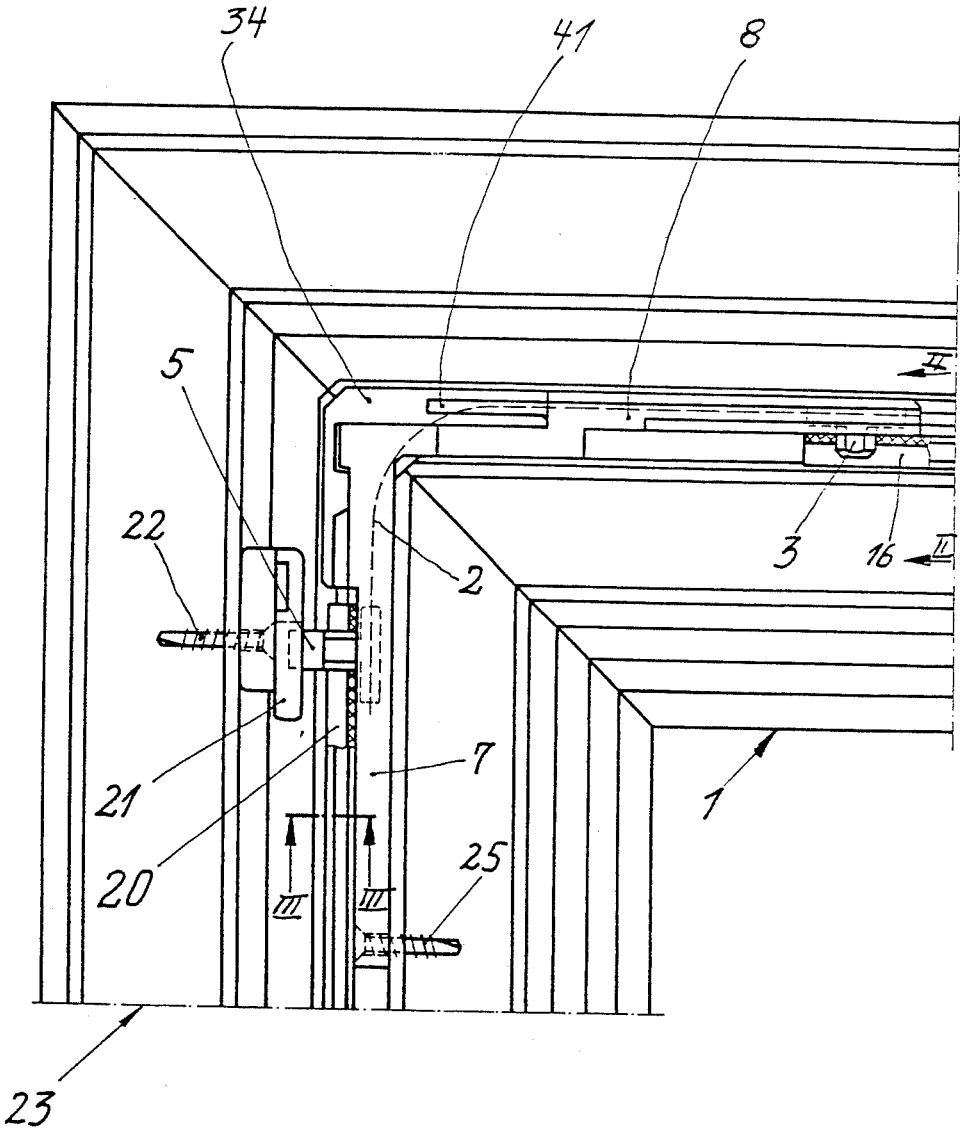
FIG. 1 is a partially sectioned view of an upper handle-side corner of a pivotable window.
Figure 4:
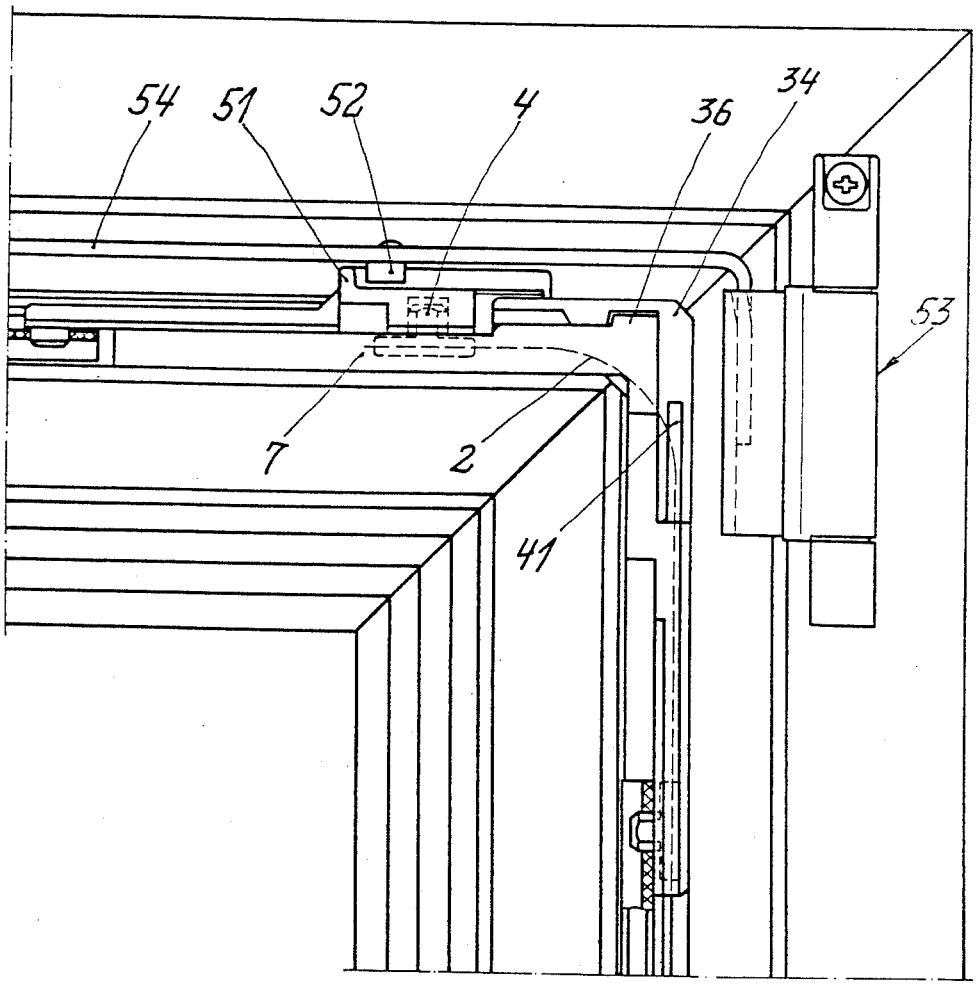
FIG. 4 is a view showing an upper hinge-side corner of a pivotable window.
Figure 5:
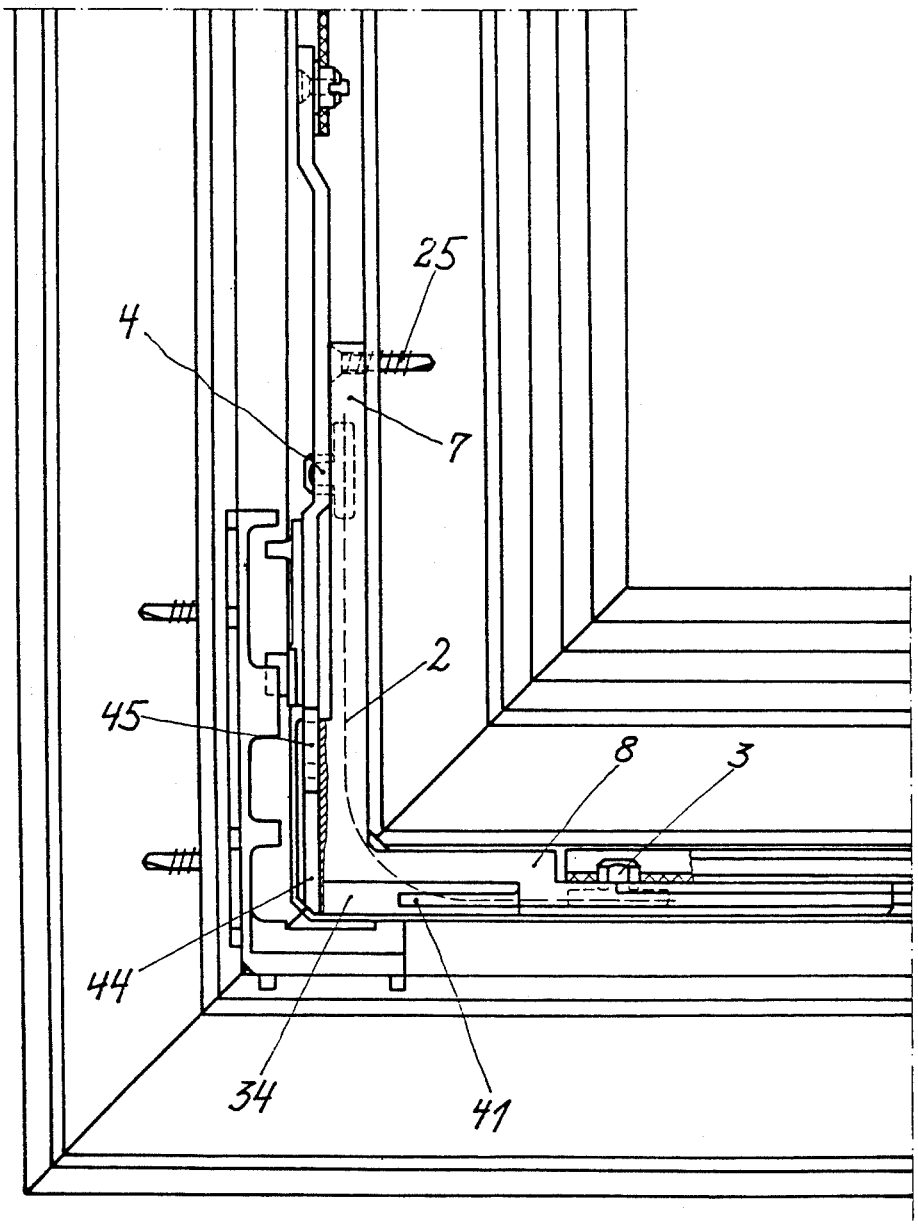
FIG. 5 is a view showing a lower handle-side corner of a pivotable window.

A pivotable and tiltable window is provided with a corner deviating or rerouting device on its handle-side upper corner shown in FIG. 1, on its hinge-side upper corner shown in FIG. 4, and on its handle-side lower corner shown in FIG. 5. The corner deviating device is mounted on a casement frame 1, and has a deviating member formed as a spring band 2. The spring band 2 is provided at its ends with drivers 3, 4, or 5. The spring band 2 is shown in FIGS. 1, 4 and 5 by a broken line.

Each corner deviating device has a housing 6, which is formed as a one-piece member. The housing 6 is provided with two legs 7 and 8, which extend at a right angle relative to one another and form guiding paths for the spring band 2. For this purpose the legs have grooves 11 which are open toward an inner chamber 9 or 10. The longitudinal edges of the spring band 2 are slidably supported in the grooves 11.

The casement frame is provided circumferentially with a receiving groove 12 for a brace, which has the same cross-section on all wings, and is provided with inwardly extending edge strips 13.

Figure 2:
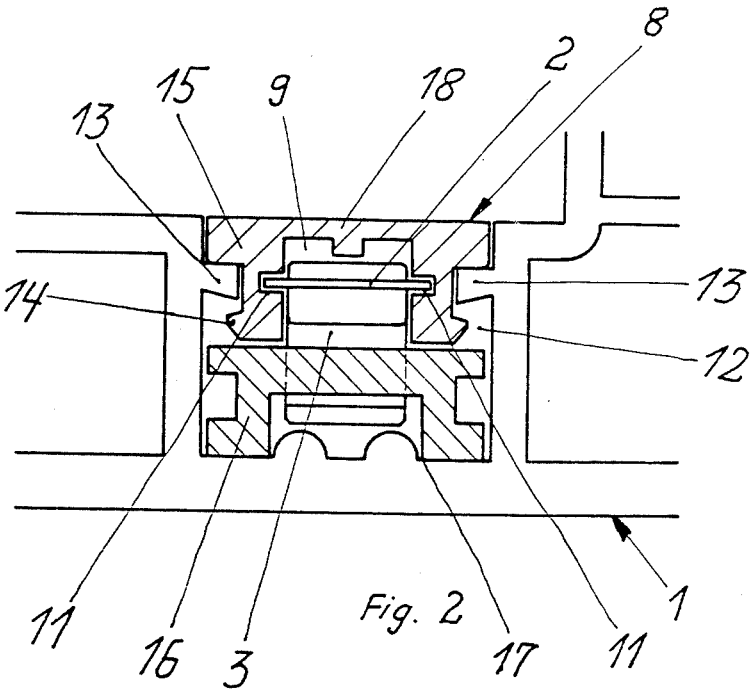
FIG. 2 is a view showing a section taken along the line II—II in FIG. 1.

In the corner deviating device of FIG. 1 the leg 8 of the housing is fixed by means of a snap connection on the edge strips 13. This type of mounting of the leg 8 is shown in FIG. 2. The leg 8 of the housing has an arresting web 14 provided on the lower longitudinal edges and engaging behind the edge strip 13. A strip 15 extends on the leg 8 parallel to the arresting web 14. A strip 15 is supported on the outer surface of the edge strip 13, and limits the insertion depth of the leg 8 in the receiving groove 12.

As can be also seen from FIG. 2, the driver 3 of the spring band engages in an opening of a locking rod 16. The locking rod 16 is arranged in the receiving groove 12 under the leg 8, and is supported slidably on a bottom 17 of the groove.

Figure 3:
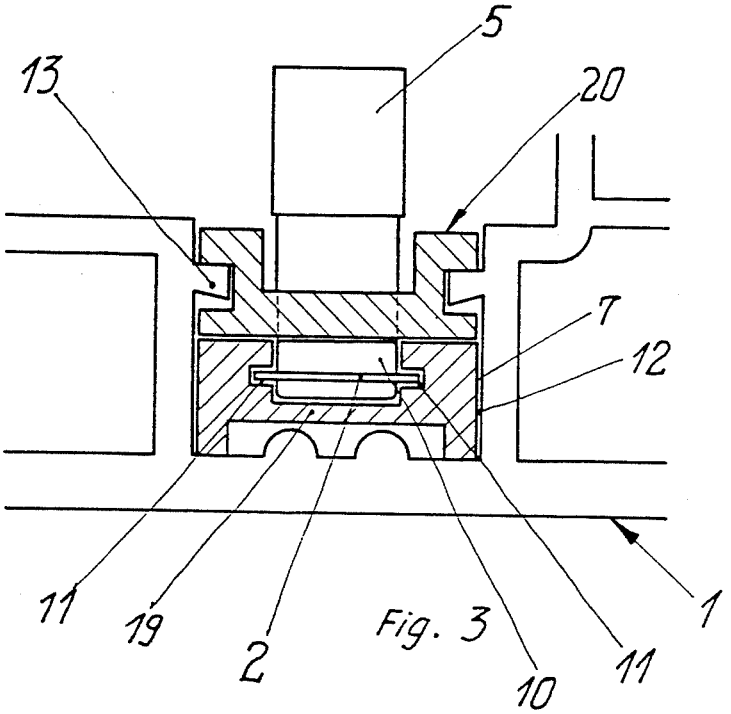
FIG. 3 is a view showing a section taken along the line III—III in FIG. 1.

The leg 8 of the housing 6 is provided with an outer bottom 18, and is open toward the interior of the receiving groove 12. The leg 7 of the housing in the corner deviating device of FIG. 1 is provided with an inner bottom 19. The leg 7 is inserted in the receiving groove 12 of the vertical leg of the casement frame from the upper corner of the casement frame in which the edge strips 12 are removed. The leg 7 then assumes the position shown in FIG. 3, and is supported on the bottom surface of the receiving groove 12. The spring band 2 is provided at that end with the driver 5, which extends through an opening of the locking rod 20. The locking rod 20 is supported slidably on the edge strip 13 of the receiving groove 12. The free end of the driver 5 extends to the region of a closing piece 21, which in turn is fixed on a frame 23 by means of a screw 22. In the closed position of the window or of the door, the driver 5 assumes the position shown in FIG. 1.

The leg 7 of the housing has at its end a through opening 24 for a mounting screw 25. The mounting screw 25 can mount the leg on the casement frame.

Figures 6, 8:
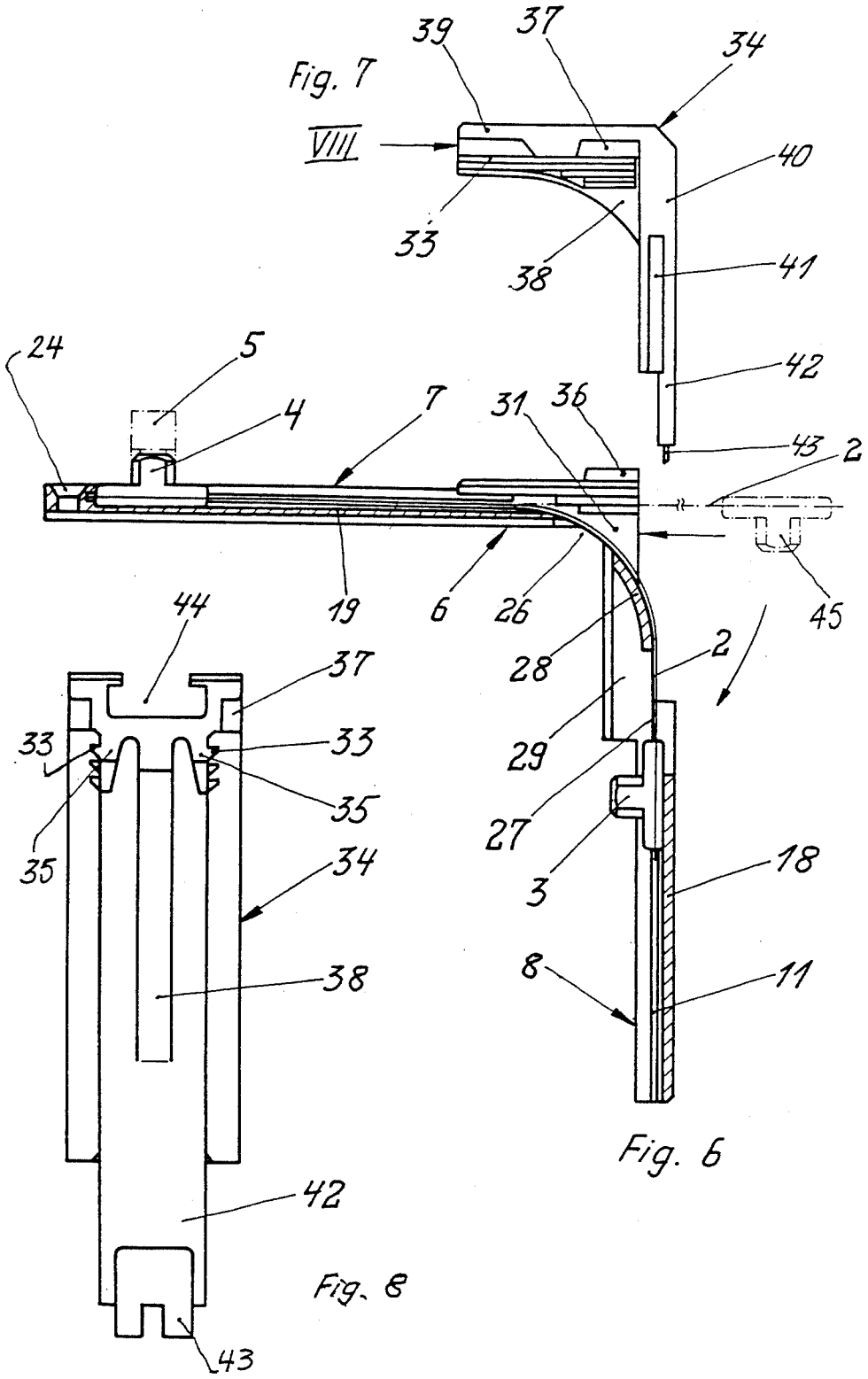
FIG. 6 is a view showing a section of a housing of a corner deviating device with an inserted deviated member.
FIG. 8 is a view in direction of the arrow VIII in FIG. 7.
Figure 9:
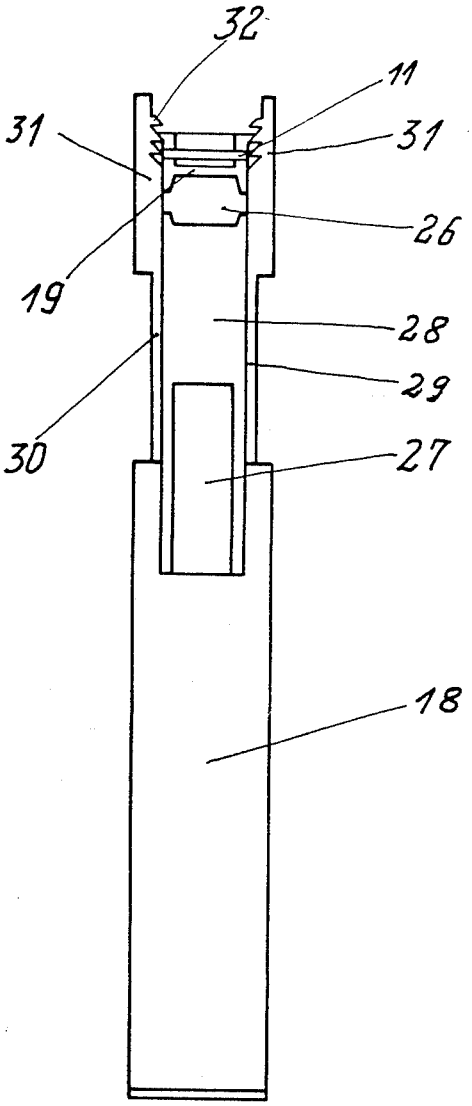
FIG. 9 is a view in direction of the arrow IX in FIG. 6.
Figure 12:
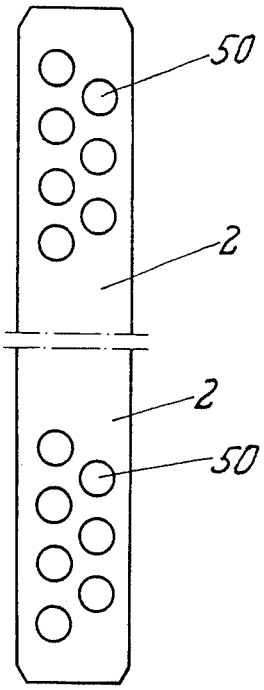
FIG. 12 is a view showing ends of the spring band which are provided with rows of openings, and on which the drivers are mounted.
Figure 10:
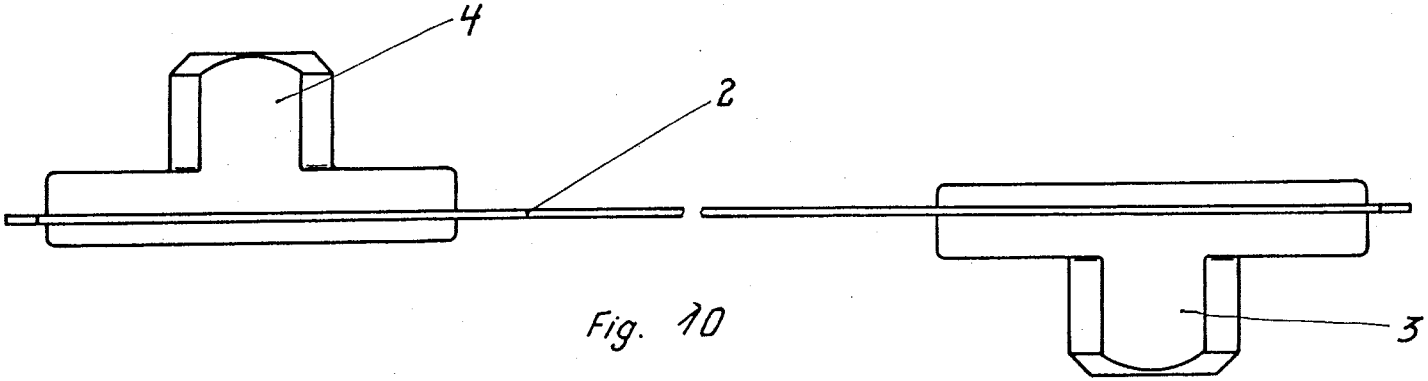
FIGS. 10 and 11 are side views showing two embodiments of a spring band provided with drivers.
Figure 11:
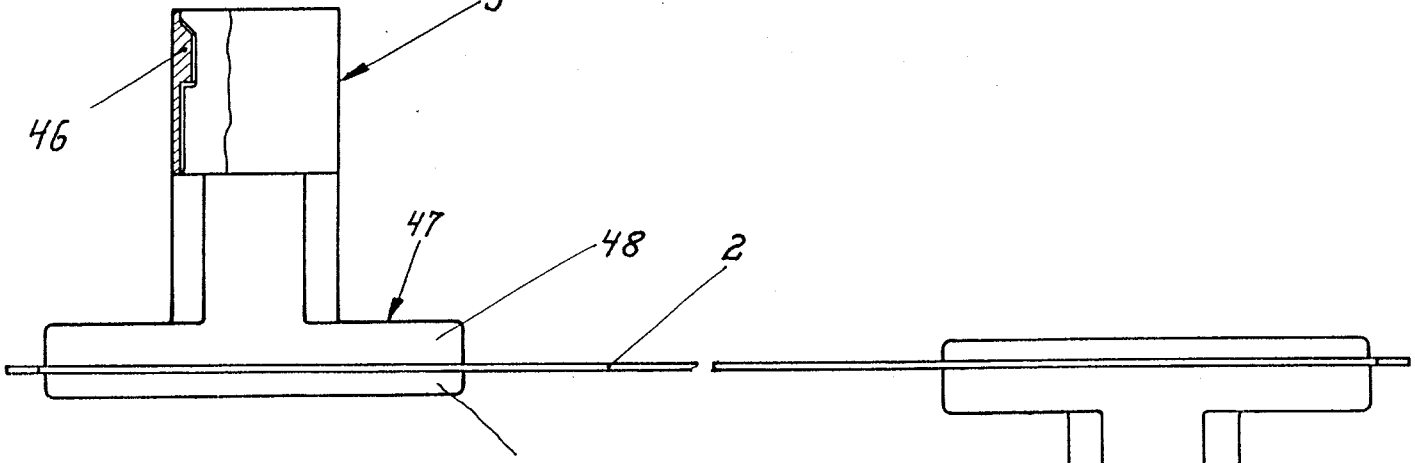

As can be seen from FIG. 6, the outer bottom 18 and the inner bottom 19 end at a distance from the corner of the housing, and cutouts 26 and 27 provided at the end surfaces of the bottom in the housing are limited on one side. The housing has an arcuate guiding piece 28 formed between the cutouts 26 and 27 for the inner side of the spring band 2. The guiding piece 28 forms a bridge between outer walls 29 and 30 of the housing.

FIG. 6 also shows the insertion of the spring band 2 with drivers associated therewith into the housing. First the end of the spring band provided with the driver 4 or 5 is inserted into the guiding grooves of the legs 7. Then the spring band is bent about the guiding piece 28, and the driver is pressed into the cut out 27, until the longitudinal edges of the spring band in the region of the driver 3 can be inserted into the guiding grooves 11 of the leg 8.

The housing 6 has in a corner region thereof side walls 31. The side walls 31 are provided on the inner side with arresting webs 32, which extend in the longitudinal direction of the leg 7 and limit arresting openings. Arresting webs 33 arranged outwardly on wall portions 35 of angular covers 34 are spring biased into the arresting openings. Projections 36 provided on the side walls 31 of the housing and particularly on its end facing toward the corner engage in recesses 37 of the covers 34 in a form-locking manner. Thereby the cover is additionally arrested in its position on the housing.

A guiding web 38 is arranged centrally between the wall parts provided with the arresting webs 33, namely on the inner side of the cover. The guiding web 38 has an acurate inner contour and forms a guide for the outer side of the spring band 2. This guiding web extends completely over the length of a leg 39 and partially over the length of the leg 40, as can be seen in FIG. 7.

The leg 40 is provided on its sides with grooves 41, which are open outwardly and at the end side. The grooves 41 serve for receiving the edge strips 13 of the receiving groove 12 of a frame wing. The cover can therefore be displaced onto the associated edge strips 13 from the corner of the frame.

FIG. 7 also shows that the leg 40 of the cover has a cover plate 42 extending beyond the grooves 41. After the mounting of the cover, it extends to the end side of the outer bottom part 18 of the housing. The cover plate 42 is provided at the front and side with at least one tongue 43 which engages the outer bottom part 18.

The leg 39 of the cover 34 is provided with a C-shaped guiding groove 44, which is open outwardly and at both end sides. The guiding groove 44 is provided for guiding a brace part, for example a finger bolt 45 in the region of the lower handle-side frame corner.

FIG. 6 shows that the drivers 3 and 4 or 5 are arranged in the housing region. The path of movement of the drivers, which is fixed on the spring band, lies in the region of the housing leg. The drivers 3, 4 and 5 are formed as pins. The driver 5 has a metal roller 46, which is supported in a rotatable manner. The driver pins are formed of one piece with a shoe 47 fixed on the spring band 2. The shoe 47 is composed of 2 plates 48 and 49 arranged at each sides of the spring band, and which are connected with one another by a plate material extending through several openings 50 of the spring band. The openings form two rows, which are offset at a distance from the central longitudinal axis of the spring band, and also relative to one another. They are offset by one half the opening distance, so that a relatively large part of spring band material is provided between the openings of the individual rows of openings. It is thereby ensured that the power flux extends nearly completely along a straight line through the spring band. The shoe of the spring band, which has a large surface, is subjected to a small surface loading during transmission of load between the spring band and the shoe.

In the corner deviating device, which is arranged in the upper hinge-side corner region, the driver 4 is coupled with a bolt piece 51. The bolt piece 51 engages a pin 52 of an exposed arm 54 articulately connected with a pivot bearing 53, both in the closed position and in the pivoted position of the illustrated pivotable window. The cover 34 of the corner deviating device is advantageously also composed of plastic, as is the housing 6.

The present invention is not limited to the details shown, since various modifications and structural changes are possible with out departing in any way from the spirit of the present invention. What is desired to be protected by Letters Patent is set forth in particular in the appended claims.

We claim:

1. A corner deviating device of a locking bar brace with locking rods slidably supported in C-shaped receiving grooves of a casement frame of a window or a door, with receiving grooves formed with identical cross sections in all wings of the casement frame and having inwardly extending edge strips which are removed in a corner region of the casement frame for forming a mounting opening, the corner deviating device comprising an angular housing mountable on the casement frame and having at least two legs;

a deviating member which is mounted on said housing and formed as a spring band which has two ends and is provided at said ends with drivers for associated locking bars thereof, said housing being formed as a one-piece member and having a corner region provided with a mounting opening for insertion of said spring band with said drivers therethrough; and an angular cover which closes said mounting opening, said legs of said housing being formed so that one of said legs is insertable into the receiving groove of one wing of the frame, and another of said legs is fixable on the edge strip of the associated receiving groove of another wing of the frame.

2. A corner deviating device as defined in claim 1, wherein said one leg of said housing has an outer bottom and is open inwardly, said other leg of said housing being provided with an inner bottom and being open outwardly.

3. A corner deviating device as defined in claim 2, wherein said housing has a corner region, and is provided in said corner region with cutouts, said outer bottom and said inner bottom ending at a distance from said corner, and limiting said cutouts at one side of the latter.

4. A corner deviating device as defined in claim 3, wherein said spring band has an inner side; and further comprising an arcuate guiding piece arranged between said cutouts for said inner side of said spring band.

5. A corner deviating device as defined in claim 1, and further comprising arresting means for fixing said other leg on the edge strip.

6. A corner deviating device as defined in claim 5, wherein said other leg has lower longitudinal edges, and is provided on said lower longitudinal edges with an arresting web engaging with the edge strip of the receiving groove and with a strip extending parallel to said arresting web, and supported on an outer surface of the edge strip, respectively.

7. A corner deviating device as defined in claim 1, wherein said cover has a cover leg provided with a groove, which is open at an end side thereof outwardly, and serves for receiving the edge strip of one of the wings of the frame, said cover leg being movable from the mounting opening of the corner region of the casement frame, in which the edge strip is removed, to the edge strip which extends to the mounting opening.

8. A corner deviating device as defined in claim 7, wherein said one leg of said housing has an outer botttom, said cover leg having a cover plate which extends to an end side of said outer bottom and is provided with at least one tongue engaging said outer bottom.

9. A corner deviating device as defined in claim 7, wherein said spring band has an outer side, said angular cover having an inner side which is provided with a guiding web over said outer side of said spring band, and having an arcuate inner contour.

10. A corner deviating device as defined in claim 9, wherein said cover has also another leg, said guiding web extending completely over the length of one of said legs of said cover and partially over the length of the other of said legs of said cover.

11. A corner deviating device as defined in claim 10, wherein said one of said legs of said housing has side walls provided with arresting recesses said cover having wall parts which extend parallel and at a distance from said guiding web, said wall parts of said cover having outer arresting webs, and being spring biased into said arresting recesses of said side walls of said one of said legs of said housing.

12. A corner deviating device as defined in claim 11, wherein said side walls of said one of said legs of said housing have an inner side and are provided on said inner side with arresting webs which limit said arresting recesses.

13. A corner deviating device as defined in claim 12, wherein said cover has recesses, said side walls of said one of said legs of said housing having an end and being provided at said end with projections which engage in said recesses of said cover in a form-locking manner.

14. A corner deviating device as defined in claim 1, wherein said cover has a leg which is provided with a C-shaped guiding groove for one part of the locking bar brace, said guiding groove being open outwardly and at both end sides thereof.

15. A corner deviating device as defined in claim 1, wherein said drivers mounted on said spring band have a movement path which lies in the region of said legs of said housing.

16. A corner deviating device as defined in claim 15, wherein said drivers are formed as pins; and further comprising a shoe which is fixed on said spring band and formed of one piece with said pins.

17. A corner deviating device as defined in claim 16, wherein said spring band has a predetermined width and is provided with openings, said shoe being composed of two plates having a width which is smaller that the width of the spring band, said plates being arranged at each side of said spring band and extending through said openings of said spring band with portions connected with one another.

18. A corner deviating device as defined in claim 17, wherein said spring band has a central longitudinal axis, said openings of said spring band being arranged in two rows which are offset at a distance relative to said central longitudinal axis, and offset relative to one another.

* * * * *